US011346623B2

(12) United States Patent
Bray et al.

(10) Patent No.: US 11,346,623 B2
(45) Date of Patent: May 31, 2022

(54) FIREARM CHARGING HANDLE

(71) Applicant: Polaris Capital LLC, Orem, UT (US)

(72) Inventors: Ernest R. Bray, American Fork, UT (US); David S. Clark, Eagle Mountain, UT (US)

(73) Assignee: Polaris Capital Corporation, Orem, UT (US)

( * ) Notice: Subject to any disclaimer, the term of this patent is extended or adjusted under 35 U.S.C. 154(b) by 0 days.

(21) Appl. No.: 17/155,022

(22) Filed: Jan. 21, 2021

(65) Prior Publication Data

US 2021/0222972 A1 Jul. 22, 2021

Related U.S. Application Data

(60) Provisional application No. 62/964,088, filed on Jan. 21, 2020.

(51) Int. Cl.
*F41A 3/72* (2006.01)
*F41A 35/06* (2006.01)

(52) U.S. Cl.
CPC ..... *F41A 3/72* (2013.01); *F41A 35/06* (2013.01)

(58) Field of Classification Search
CPC ..... F41A 3/72; F41A 35/06
USPC ..... 89/1.4
See application file for complete search history.

(56) References Cited

U.S. PATENT DOCUMENTS

| | | | | |
|---|---|---|---|---|
| 9,500,421 | B1 * | 11/2016 | Geissele | F41A 3/72 |
| 9,683,795 | B1 * | 6/2017 | Novak | F41A 35/06 |
| 10,451,369 | B1 | 10/2019 | Hunt et al. | |
| 2015/0233657 | A1 | 8/2015 | Barker et al. | |
| 2015/0308761 | A1 * | 10/2015 | McGinty | F41A 35/06 89/1.4 |
| 2016/0298917 | A1 | 10/2016 | Hwang | |
| 2017/0023321 | A1 | 1/2017 | Kincel | |

OTHER PUBLICATIONS

PCT/US21/23149 Notification of Transmittal of the International Search Report and the Written Opinion of the International Searching Authority, or the Declaration, PCT, dated Dec. 8, 2021, pp. 1-18.

* cited by examiner

*Primary Examiner* — Reginald S Tillman, Jr.
(74) *Attorney, Agent, or Firm* — Kunzler Bean & Adamson

(57) ABSTRACT

An apparatus for ambidextrous control of a charging handle is disclosed. In certain examples, the charging handle includes an elongated shaft defining a centerline, and a handle body. In certain examples, the handle body includes a first protrusion extending transversely from the centerline to a distal end, and a second protrusion extending transversely, in an opposite direction than the first protrusion, from the centerline to a distal end. The handle body also includes a first lever pivotally coupled to the first protrusion at a pivot point adjacent the distal end of the first protrusion, the first lever configured to independently actuate a latch mechanism, and a second lever pivotally coupled to the second protrusion at a pivot point that is adjacent the distal end of the second protrusion, the second lever configured to independently actuate the latch mechanism.

20 Claims, 9 Drawing Sheets

FIREARM CHARGING HANDLE

CROSS-REFERENCES TO RELATED APPLICATIONS

This application claims the benefit of, and claims priority to, U.S. Provisional Patent Application No. 62/964,088 entitled "IMPROVED FIREARM CHARGING HANDLE" and filed on Jan. 21, 2020 for Ernest R. Bray, et. al, which is incorporated herein by reference.

FIELD

This disclosure relates generally to firearms, and more particularly to a charging handle for securing and releasing the bolt carrier of a firearm.

BACKGROUND

A charging handle is useful to secure and release a bolt carrier of a firearm. With regards to the M16 family of firearms, the charging handle is used to load ammunition, clear malfunctions, and retract the bolt carrier for cleaning and inspection. Typically, the charging handle is disposed within an upper receiver of the M16, and its equivalents, with a portion of the handle (i.e., the shaft) that extends axially along the length of the firearm alongside the bolt carrier to engage a forward or muzzle end of the bolt carrier.

Most ambidextrous charging handles for M-16 platform-based firearms (e.g., AR platforms) have latches that are "radially opposed" and pivot from the center of the body of the handle back and either to the right or left. When these charging handles are operated by military and law enforcement personnel in their typically rough manner, the binding action which is put on the shaft portion of the handle body is subject to binding forces, which stresses the shaft, often leading to the shaft bending or breaking. Additionally, the pins which hold the latches in the body are subjected to a higher level of stress and often break, rendering the weapon inoperable. The radially opposed levers are also subject to snagging on gear, which causes the levers to be released from the upper receiver where they are exposed to getting caught in gear, which leads to bending and breaking.

SUMMARY

An apparatus for ambidextrous control of a charging handle is disclosed. In certain examples, the charging handle includes an elongated shaft defining a centerline, and a handle body. In certain examples, the handle body includes a first protrusion extending transversely from the centerline to a distal end, and a second protrusion extending transversely, in an opposite direction than the first protrusion, from the centerline to a distal end. The handle body also includes a first lever pivotally coupled to the first protrusion at a pivot point adjacent the distal end of the first protrusion, the first lever configured to independently actuate a latch mechanism, and a second lever pivotally coupled to the second protrusion at a pivot point that is adjacent the distal end of the second protrusion, the second lever configured to independently actuate the latch mechanism.

In certain examples, the latch mechanism comprises an elongated latch arm that defines a longitudinal axis. The latch mechanism, in certain examples, includes a first arm extending outward from the longitudinal axis in a first direction and a second arm that extends outward from the longitudinal axis in a second direction. The charging handle includes, in certain examples, a pivot point disposed in the first arm and offset from the longitudinal axis.

The first lever, when actuated in certain examples, contacts the first arm and causes the latch mechanism to pivot about the pivot point and release the latch arm from a firearm. In certain examples, the handle body includes a toggle member disposed between the second arm and the second lever such that actuation of the second lever pivots the toggle member which contacts the second arm and causes the latch mechanism to pivot about the pivot point and release the latch arm from a firearm. The handle body may also include a guide rod disposed within the handle body along the centerline and openings in the second arm and the toggle member through which the guide rod passes. In certain examples, the charging handle includes a spring disposed around the guide rod and between the elongated shaft and the second arm, where the spring is configured to urge the latch mechanism into a locking position.

In certain examples, each of the first lever and the second lever comprise a slot configured to define a path and a limit of movement of each lever. In certain examples, the elongated shaft is formed having a first end coupled to the handle body and a second end comprising a bolt carrier engagement point. The bolt carrier engagement point has, in certain examples, a convex surface extending towards the first end. Each of the first lever and the second lever has, in certain examples an index wing extending towards the second end.

A firearm having an ambidextrous charging handle is also disclosed. In certain examples, the firearm includes an upper receiver having a barrel that defines a bore axis, and a lower receiver coupled to the upper receiver having a magazine well. The firearm also includes, in certain examples, a bolt carrier configured to eject spent shells and load new rounds into the barrel, and the charging handle to manually actuate the bolt carrier.

BRIEF DESCRIPTION OF THE DRAWINGS

In order that the advantages of the invention will be readily understood, a more particular description of the invention briefly described above will be rendered by reference to specific examples that are illustrated in the appended drawings. Understanding that these drawings depict only typical examples of the invention and are not therefore to be considered to be limiting of its scope, the invention will be described and explained with additional specificity and detail through the use of the accompanying drawings, in which.

DETAILED DESCRIPTION

Reference throughout this specification to "one example," "an example," or similar language means that a particular feature, structure, or characteristic described in connection with the example is included in at least one example of the present disclosure. Appearances of the phrases "in one example," "in an example," and similar language throughout this specification may, but do not necessarily, all refer to the same example. Similarly, the use of the term "implementation" means an implementation having a particular feature, structure, or characteristic described in connection with one or more examples of the present disclosure, however, absent an express correlation to indicate otherwise, an implementation may be associated with one or more examples.

Figure 1:
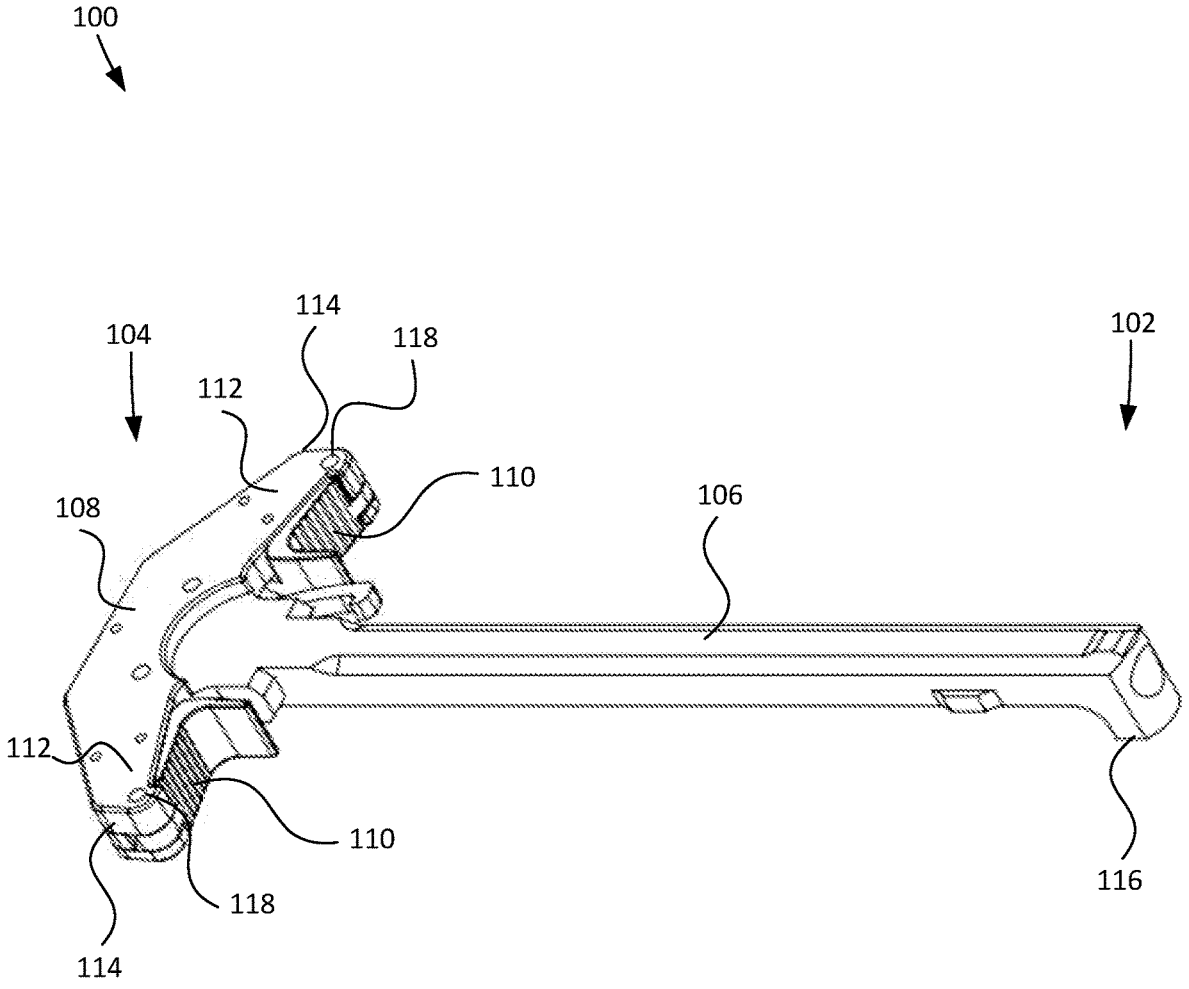
FIG. 1 is a perspective view diagram of a charging handle in accordance with examples of the subject disclosure.

FIG. 1 is a perspective view diagram of a charging handle 100 in accordance with examples of the subject disclosure. The charging handle 100, in the depicted embodiment, may be used with the M16 family of firearms including, but not limited to, all AR variants, the M16 firearm, the M4 firearm, and others with use a bolt carrier. As used herein, the terms "forward" and "front" refer to ends of mechanisms that are nearest the muzzle end of the firearm (see FIG. 8). Similarly, "rear," "rearward," correspond to ends of mechanisms that are nearest to the stock of the firearm. Accordingly, the charging handle 100 is formed as an elongated device having a "forward" first end 102 and a "rearward" second end 104. The first end 102, when disposed within an upper receiver of the firearm, is nearest the muzzle end of the firearm, and the charging handle 100 extends axially rearward towards the stock.

The charging handle 100 consists of a shaft 106 that extends from a handle body 108 to the first end 102. The handle body 108, in certain embodiments, is rigidly coupled with the shaft 106. The handle body 108 houses a pair of levers 110 that are pivotally coupled with the handle body 108. The handle body 108 extends transversely from a longitudinal axis of the shaft 106 to form a T-shape. The outward protrusions 112 extend from the shaft 106 to distal ends 114. The protrusions 112 form grasp points that a firearm user may use to pull the charging handle 100 longitudinally rearward and cause a lip 116 or engagement point to engage the bolt carrier.

In certain examples, the levers 110 are pivotally coupled to the handle body 108 by pivot pins 118 disposed adjacent the distal ends 114. In other examples, other fastening devices are contemplated. This arrangement, beneficially, directs a pulling force in a direction that is substantially parallel to a direction of travel of the charging handle 100. Conversely, common charging handles have levers that pivot near the shaft, and consequently a pulling force is at an angle to the direction of travel of the charging handle. This causes binding of the charging handle. Beneficially, the levers 110 of the subject disclosure do not place left- or right-handed binding forces on the shaft 106. The charging operation is smoother with less chance of creating a miss-feed malfunction, and wear is reduced.

Additionally, in combat operations, when entering a vehicle for transport, users (e.g., soldiers and law enforcement officers) typically clear a live round and lock the bolt carrier to the rear. When this is done, there is no pressure from the recoil/buffer spring holding the charging handle 100 in the forward position. When entering and leaving a vehicle, the levers on common charging handles snag on gear and accidentally extend, where they often are bent or broken. Common levers are also exposed to breaking off. Conversely, in the examples of the subject disclosure, the levers 110 are stopped by the handle body 108 which prevents over travel and stress on the pins 118. Inadvertent opening when coming in contact with gear or other equipment is greatly reduced as the levers 110 only operate when pressure is put on the levers near the longitudinal axis of the charging handle 100.

Figure 2:
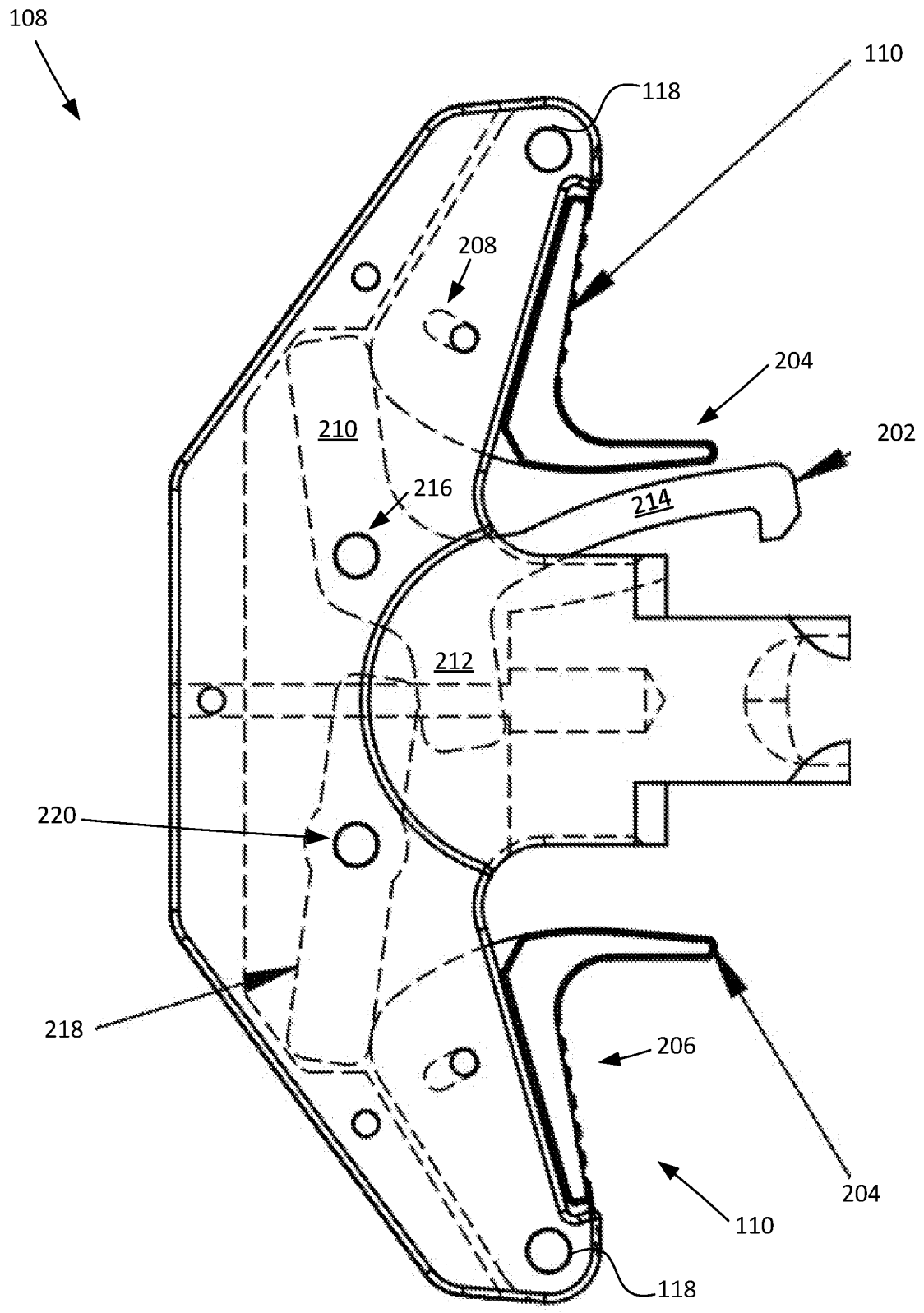
FIG. 2 is a side view diagram illustrating a partial view of the handle body according to examples of the subject disclosure.

FIG. 2 is a side view diagram illustrating a partial view of the handle body 108 according to examples of the subject disclosure. The levers 110, in certain examples, are independently operable to activate a latch mechanism (hereinafter "latch") 202. The latch 202 is configured to engage a notch formed on an exterior surface of the upper receiver of a firearm, as known to those of skill in the art. The levers 110 are configured to independently move the latch 202 from a latched position to an unlatched position. FIG. 2 is a depiction of the unlatched position.

Each lever 110, in certain examples, includes an indexing wing 204 that extends from a finger engagement surface 206 forward towards the lip 116. The indexing wings 204 beneficially provide for proper indexing of the user's fingers or hand to align forces along a centerline of the charging handle 100 to prevent binding. The indexing wings 204 also prevent pinching of a finger between the charging handle 100 and the upper receiver of the firearm.

Each lever 110, as described above, is configured to pivot about the pivot pin 118 that is disposed adjacent the distal end 114 of the protrusions 112. A slot 208, through which a pin is inserted, may be formed in the lever 110 to define and limit the travel of the lever 110 by following the pin. The latch 202 includes a first arm 210 and a second arm 212 that extend transversely from a longitudinal axis of a latch arm 214. A pivot point 216 may be disposed within a body of the first arm 210. In certain examples, the left-side lever 110 (in the depicted embodiment, the upper lever 110) engages the first arm 210 to pivot the latch arm 214, and subsequently a hook of the latch arm 214, away from the upper receiver to the unlatched position.

Depressing the right-hand lever 110 (the lower lever 110 in FIG. 2) engages a toggle member 218. The toggle member 218, in certain examples, is an elongated member that rotates about a pivot point 220. Engaging the lower lever 110 causes a rear surface of the lever 110 to push on a distal end 222 (i.e., an end furthest from a centerline of the shaft 106) of the toggle member 218 and rotate the toggle member 218. This rotation causes a proximal end 224 to push on the second arm 212 of the latch 202 and cause the hook of the latch arm 214 to move away from the upper receiver to the unlatched position.

Figure 3:
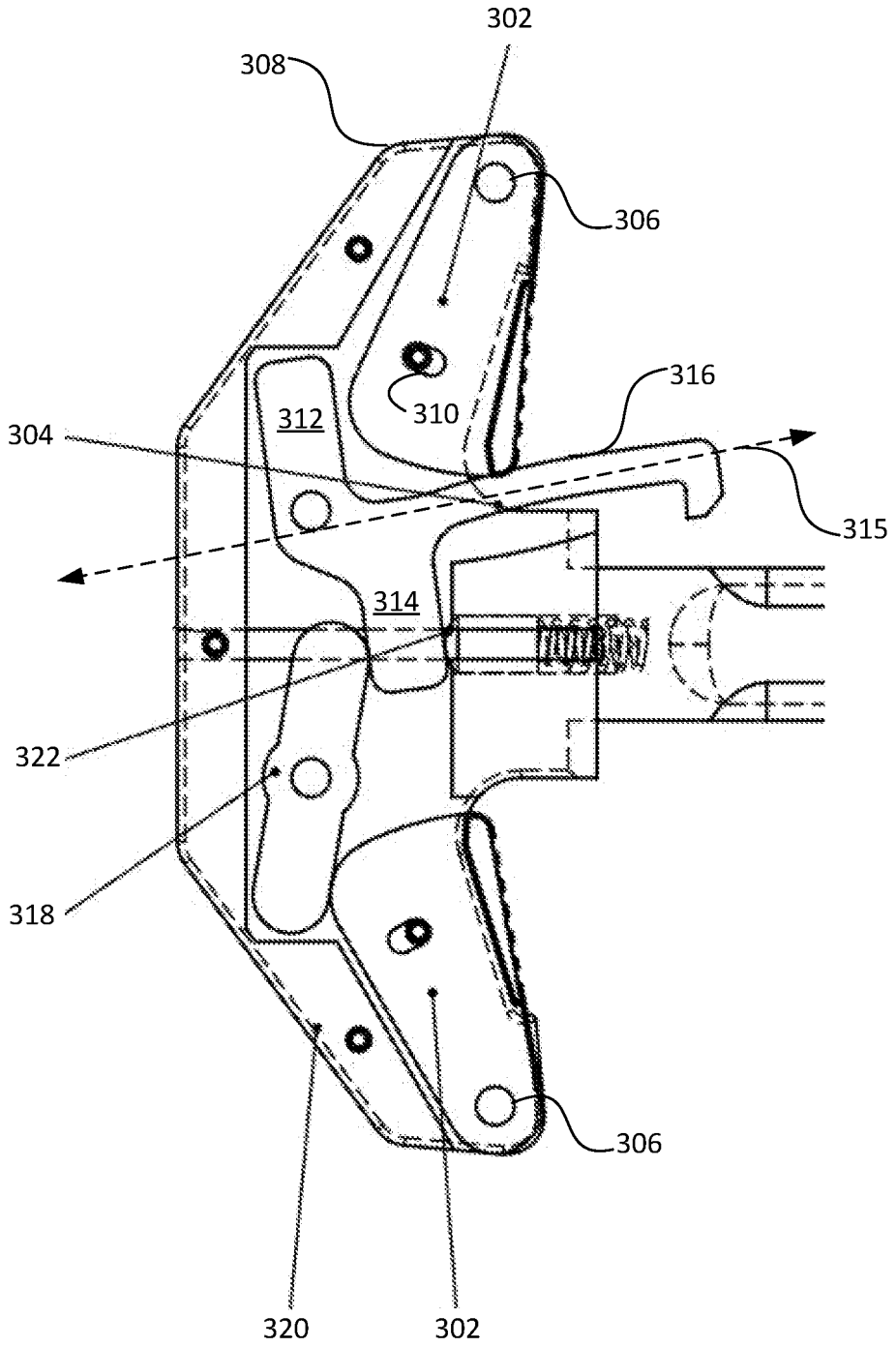
FIGS. 3 and 4 are side view diagrams illustrating a partial view of the handle body according to examples of the subject disclosure.
Figure 4:
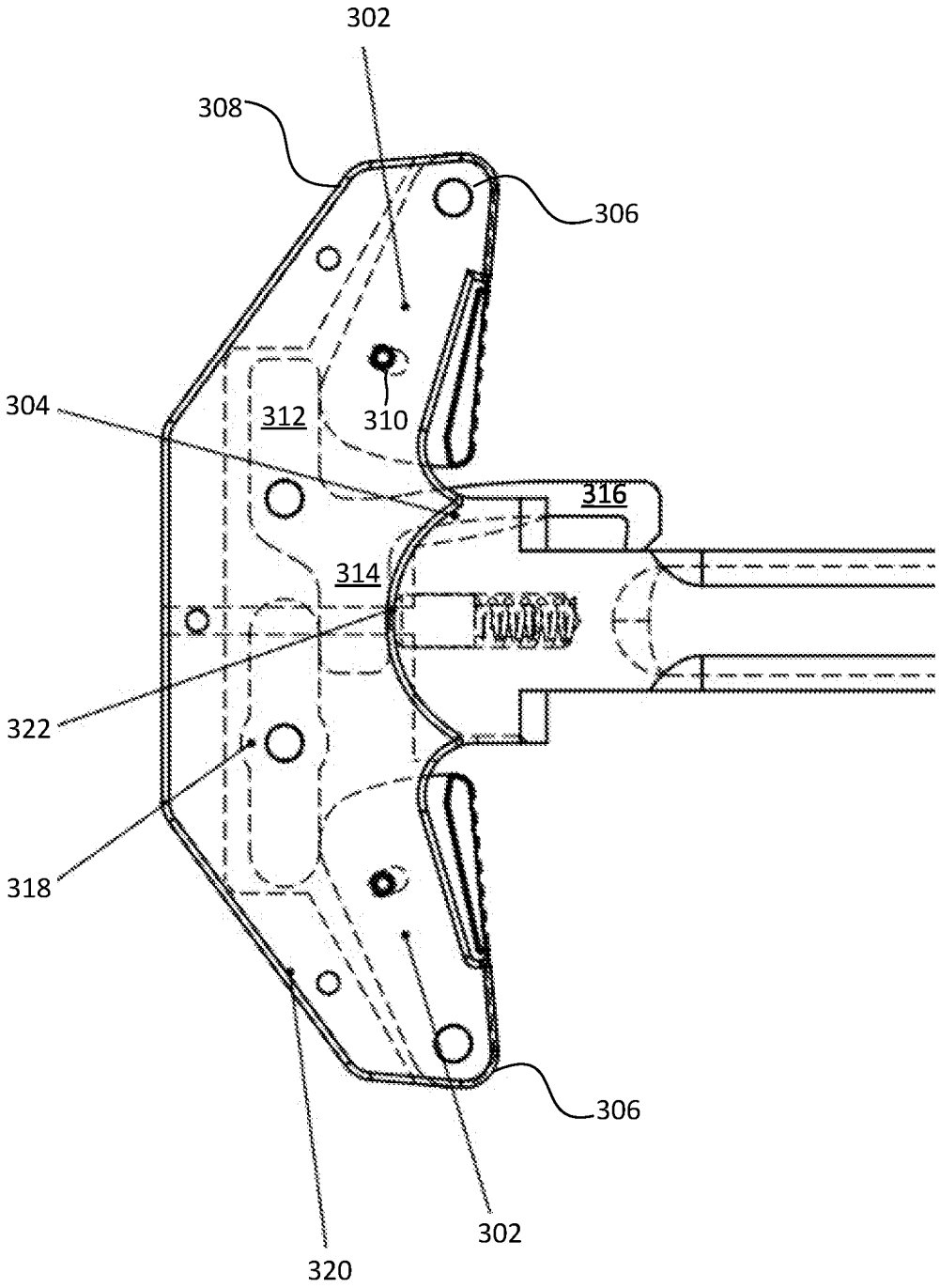

FIG. 3 is a side view diagram illustrating a partial view of the handle body 108 according to examples of the subject disclosure. FIG. 3 depicts an alternative embodiment of the handle body 108. In particular, the levers 302 are depicted here without the indexing wings 204 described above with respect to FIG. 2. Similarly, FIG. 4 is an alternative view of FIG. 3 that depicts the levers without indexing wings, but in a latched position instead of the unlatched position depicted in FIG. 3.

In particular, the levers 302, in certain examples, are independently operable to activate a latch mechanism (hereinafter "latch") 304. The latch 304 is configured to engage a notch formed on an exterior surface of the upper receiver of a firearm. The levers 302 are configured to independently move the latch 304 from a latched position to an unlatched position.

Each lever 302, as described above, is configured to pivot about the pivot pin 306 that is disposed adjacent the distal end 308 of the protrusions. A slot 310 may be formed in the lever 302 to define and limit the travel of the lever 302. The latch 304 includes a first arm 312 and a second arm 314 that extend transversely from a longitudinal axis 315 of a latch arm 316. A pivot point may be disposed within a body of the first arm 312. In certain examples, the left-side lever 302 (in the depicted embodiment, the upper lever 110) engages the first arm 312 to pivot the latch arm 316, and subsequently a hook of the latch arm 316, away from the upper receiver to the unlatched position.

Depressing the right-hand lever 302 (the lower lever 110 in FIG. 2) engages a toggle member 318. The toggle member 318, in certain examples, is an elongated member that rotates about a pivot point. Engaging the lower lever 302 causes a rear surface of the lever 302 to push on a distal end (i.e., an end furthest from a centerline of the shaft 106) of the toggle member 318 and rotate the toggle member 318. This rotation causes a proximal end to push on the second arm 314 of the latch 202 and cause the hook of the latch arm 316 to move away from the upper receiver to the unlatched position. Also depicted is a stop 320, which is formed to limit the travel of the lever 302, and a spring or biasing member 322 which urges the levers 302 and latch 304 into a latched position.

Figure 5:
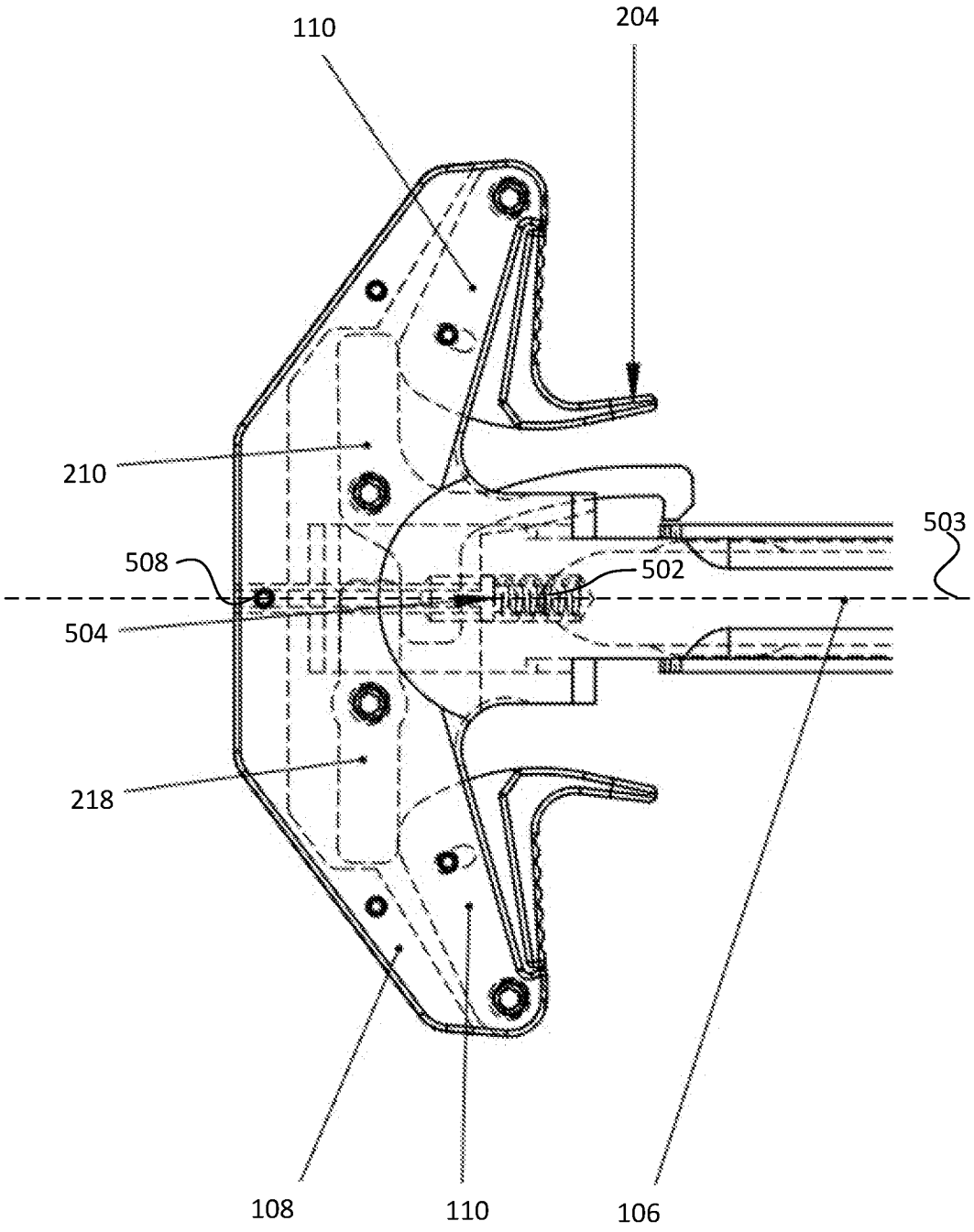
FIG. 5 is a side view diagram illustrating a partial view of the handle body in a latched position according to examples of the present disclosure.

FIG. 5 is a side view diagram illustrating a partial view of the handle body in a latched position according to examples of the present disclosure. A rod 502 (i.e., guide rod), in certain examples, is disposed within the handle body 108 along the centerline 503 (i.e., longitudinal axis that is substantially parallel with a bore axis of a firearm barrel) of the shaft 106. The rod 502, in certain examples is disposed within the spring 504. Openings in the second arm 212 and the toggle member 218 allow the rod 502 to pass therethrough and act as a guide to the pivoting movement of the latch 202 and the toggle member 218. The rod 502 may be slidably coupled at one end with the shaft 106 and removably coupled at another end with the handle body 108. A pin 508 may secure the rod 502 in place. The opening in the shaft 106 that receives the rod 502, in one example, is oversized to receive the rod 502, a spring 504, and a detent. The spring 504, in one example, urges the second arm 212 to return to a latched position. Unlatching the charging handle 100 requires that the user overcomes the force of the spring 504.

Figure 6A:
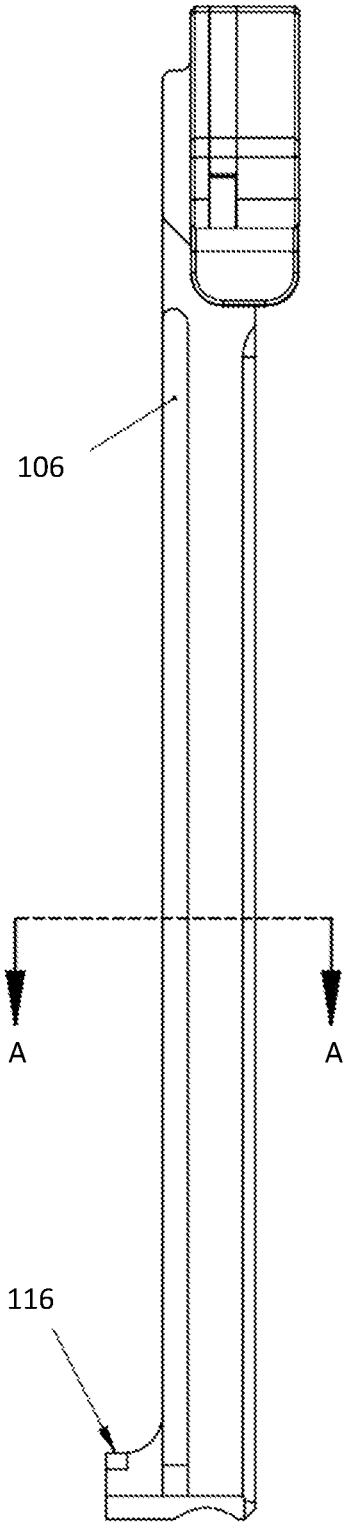
FIGS. 6*a*-7 are views of the charging handle in accordance with examples of the subject disclosure.
Figure 6B:
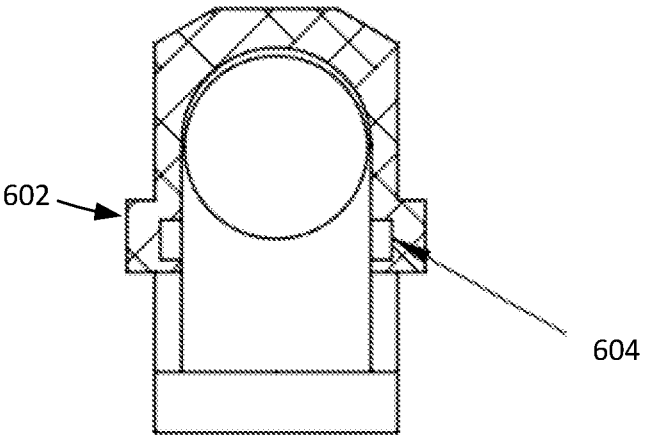
Figure 7:
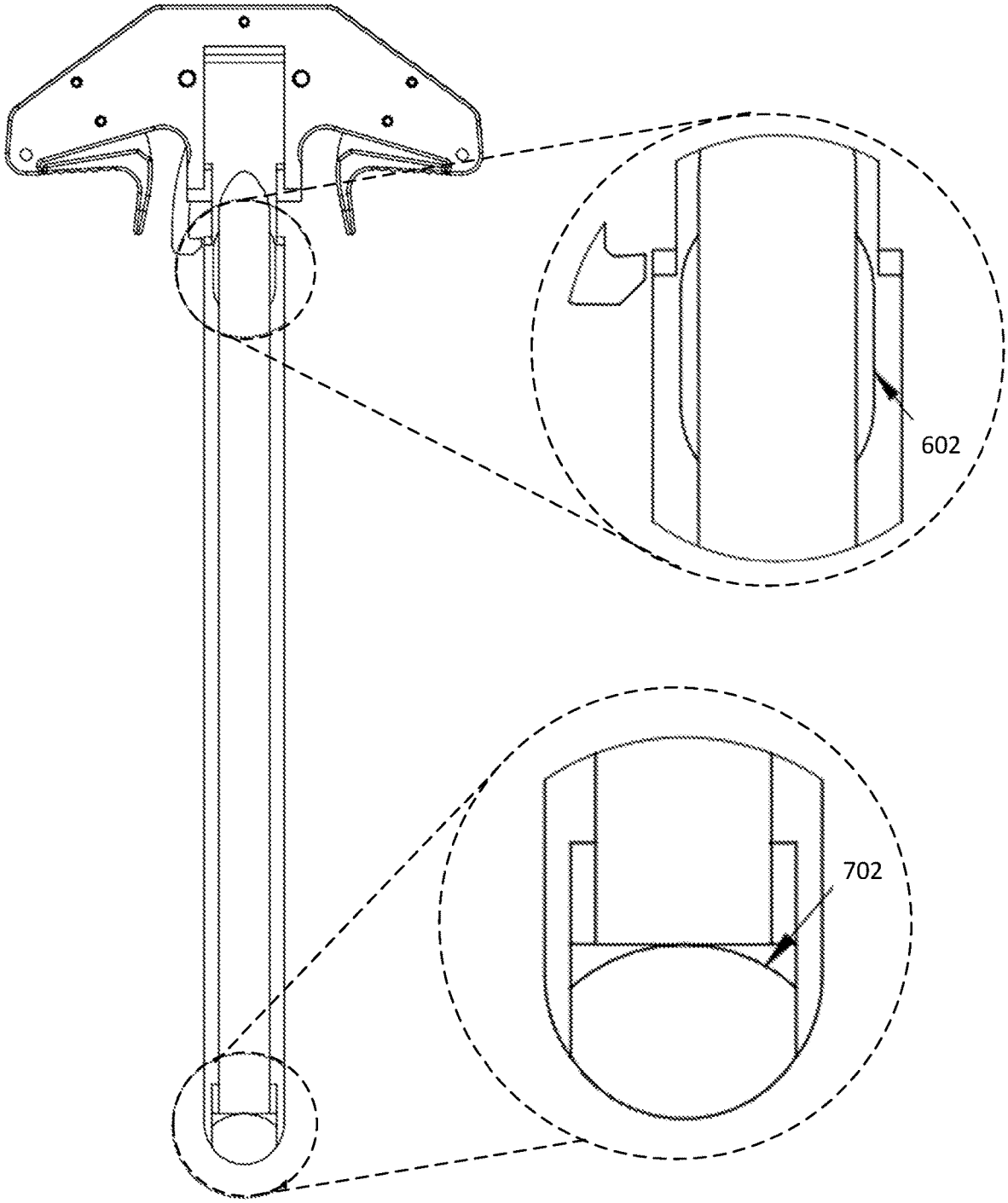

FIGS. 6*a*-7 are views of the charging handle 100 in accordance with examples of the subject disclosure. FIG. 6*a* is a side-view diagram, and FIG. 6*b* is a cross-sectional view diagram taken along line A-A of FIG. 6*a*. In the depicted embodiment, the lip 116 on the front of the charging handle shaft 106 where it engages the bolt carrier is rounded (see FIG. 7, which shows a bottom view of the charging handle 100, and reference number 702 which identifies the rounded portion) providing more bearing surface and a thicker portion of material. In certain examples, the rounded portion 702 defines a convex surface that extends toward the rear of the firearm. When paired with a compatible bolt carrier, this helps prevent breakage of that area, which allows the charging handle shaft 106 to move over the engagement shelf on the bolt carrier and wedge between a carrier key and top of the bolt carrier, which otherwise can bind the action and prevent operation.

In another example, the shaft 106 of the charging handle 100 has external rails 602 that interface with grooves in a charging handle cutout in the upper receiver. In another example, there may be grooves 604 creating a track cut into an inside hollow portion of the shaft 106 that interface with "wings" (e.g., small rail segments that are on the carrier key or added to the bolt carrier). This arrangement prevents carrier tilt, smoother operation and allows the use of sorter or half-length bolt carriers.

Figure 8:
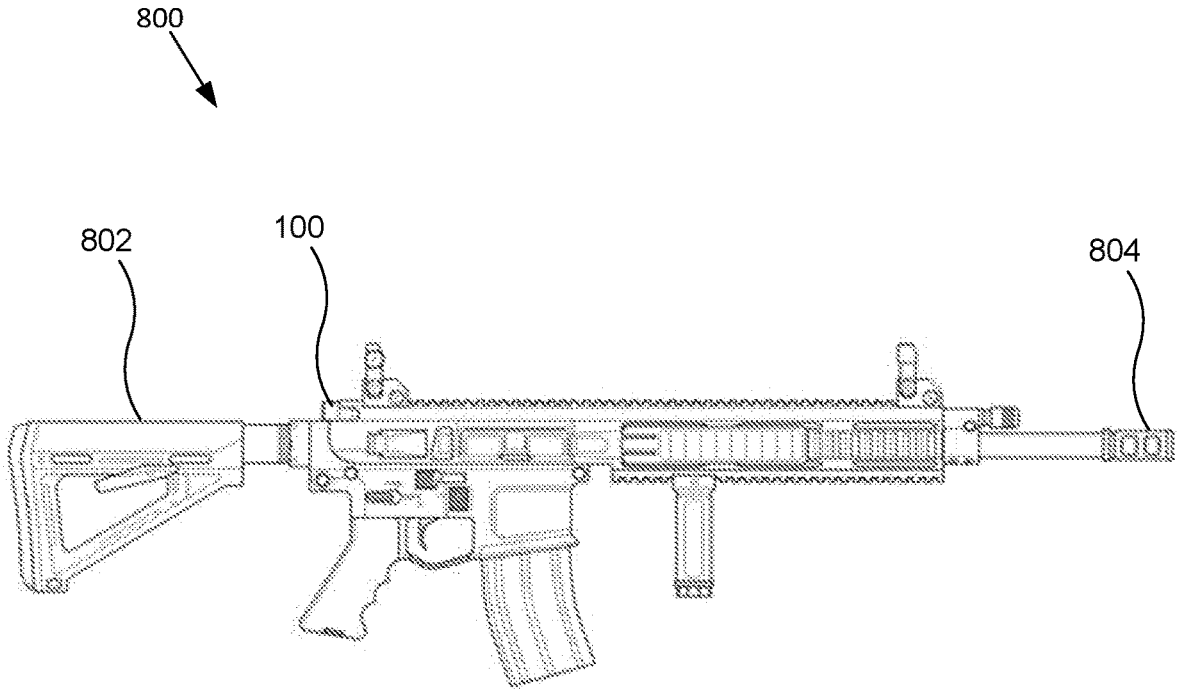
FIG. 8 is a side view diagram illustrating one embodiment of a rifle including an improved charging handle 100 in accordance with embodiments of the present disclosure.

FIG. 8 is a side view diagram illustrating one embodiment of a rifle 800 including an improved charging handle 100 in accordance with embodiments of the present disclosure. As described above, the charging handle 100 is configured to slidably engage an upper receiver of the rifle 800. The charging handle 100 is configured to slide rearwardly towards the stock 802, and away from the muzzle end 804, when a user pulls on a lever 110 of the charging handle 100.

Figure 9:
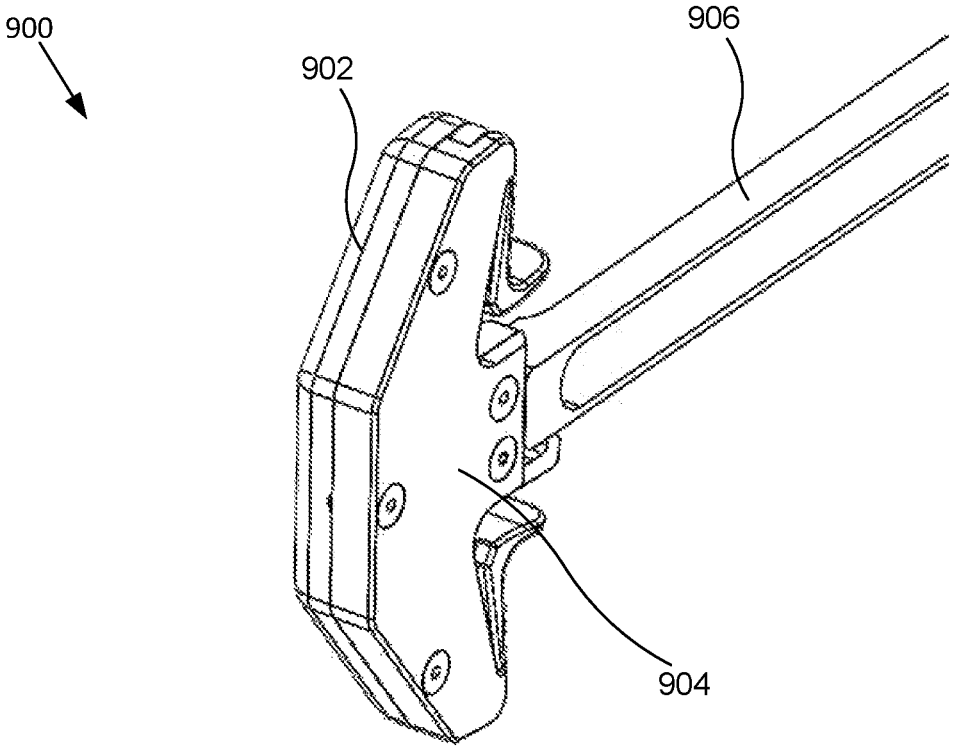
FIG. 9 is a perspective view diagram of a bottom of the charging handle 100 in accordance with examples of the subject disclosure.

FIG. 9 is a perspective view diagram of a bottom of the charging handle 100 in accordance with examples of the subject disclosure. The shaft and the handle may be formed of a single unitary piece, or alternatively, and as depicted, as separate pieces that are coupled together. A housing 902 may hold the internal components described above with reference to FIGS. 1-8, with a bottom plate 904 enclosing the housing. Fasteners 906 may secure the bottom plate 904 to the housing 902 and the shaft 906.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two."

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The schematic flow chart diagrams included herein are generally set forth as logical flow chart diagrams. As such, the depicted order and labeled steps are indicative of one example of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

The present subject matter may be embodied in other specific forms without departing from its spirit or essential characteristics. The described examples are to be considered in all respects only as illustrative and not restrictive. All changes which come within the meaning and range of equivalency of the claims are to be embraced within their scope.

What is claimed is:

1. A charging handle for a rifle, comprising:
an elongated shaft defining a centerline;
a handle body comprising:
a first protrusion extending transversely from the centerline to a distal end;
a second protrusion extending transversely, in an opposite direction than the first protrusion, from the centerline to a distal end;
a first lever disposed within and pivotally coupled to the first protrusion at a pivot point adjacent the distal end of the first protrusion, the first lever configured to pivot about the distal end of the first protrusion and to independently actuate a latch mechanism; and
a second lever disposed within and pivotally coupled to the second protrusion at a pivot point that is adjacent the distal end of the second protrusion, the second lever configured to pivot about the distal end of the second protrusion and to independently actuate the latch mechanism.

2. The charging handle of claim 1, where the latch mechanism comprises an elongated latch arm that defines a longitudinal axis.

3. The charging handle of claim 2, where the latch mechanism further comprises a first arm extending outward from the longitudinal axis in a first direction and a second arm that extends outward from the longitudinal axis in a second direction.

4. The charging handle of claim 3, further comprising a pivot point disposed in the first arm and offset from the longitudinal axis.

5. The charging handle of claim 4, where the first lever, when actuated, contacts the first arm and causes the latch mechanism to pivot about the pivot point and release the latch arm from a firearm.

6. The charging handle of claim 4, further comprising a toggle member disposed between the second arm and the second lever such that actuation of the second lever pivots the toggle member which contacts the second arm and causes the latch mechanism to pivot about the pivot point and release the latch arm from a firearm.

7. The charging handle of claim 6, further comprising a guide rod disposed within the handle body along the centerline.

8. The charging handle of claim 7, further comprising openings in the second arm and the toggle member through which the guide rod passes.

9. The charging handle of claim 7, further comprising a spring disposed around the guide rod and between the elongated shaft and the second arm, where the spring is configured to urge the latch mechanism into a locking position.

10. The charging handle of claim 1, where each of the first lever and the second lever comprise a slot configured to define a path and a limit of movement of each lever.

11. The charging handle of claim 1, where the elongated shaft comprises a first end coupled to the handle body and a second end comprising a bolt carrier engagement point.

12. The charging handle of claim 11, where the bolt carrier engagement point comprises a convex surface extending towards the first end.

13. The charging handle of claim 11, where each of the first lever and the second lever comprise an index wing extending towards the second end.

14. A firearm comprising:
an upper receiver having a barrel that defines a bore axis;
a lower receiver coupled to the upper receiver having a magazine well;
a bolt carrier configured to eject spent shells and load new rounds into the barrel; and
a charging handle to manually actuate the bolt carrier, the charging handle comprising:
an elongated shaft defining a centerline;
a handle body comprising:
a first protrusion extending transversely from the centerline to a distal end;

a second protrusion extending transversely, in an opposite direction than the first protrusion, from the centerline to a distal end;

a first lever disposed within and pivotally coupled to the first protrusion at a pivot point adjacent the distal end of the first protrusion, the first lever configured to pivot about the distal end of the first protrusion and to independently actuate a latch mechanism; and a second lever disposed within and pivotally coupled to the second protrusion at a pivot point that is adjacent the distal end of the second protrusion, the second lever configured to pivot about the distal end of the second protrusion and to independently actuate the latch mechanism.

15. The firearm of claim 14, where the latch mechanism comprises an elongated latch arm that defines a longitudinal axis.

16. The firearm of claim 15, where the latch mechanism further comprises a first arm extending outward from the longitudinal axis in a first direction and a second arm that extends outward from the longitudinal axis in a second direction.

17. The firearm of claim 16, further comprising a pivot point disposed in the first arm and offset from the longitudinal axis.

18. The firearm of claim 17, where the first lever, when actuated, contacts the first arm and causes the latch mechanism to pivot about the pivot point and release the latch arm from a firearm.

19. The firearm of claim 17, further comprising a toggle member disposed between the second arm and the second lever such that actuation of the second lever pivots the toggle member which contacts the second arm and causes the latch mechanism to pivot about the pivot point and release the latch arm from a firearm.

20. A charging handle for a rifle, comprising:

an elongated shaft defining a centerline, where the elongated shaft comprises a first end coupled to the handle body and a second end comprising a bolt carrier engagement point, and where the bolt carrier engagement point comprises a convex surface extending towards the first end;

a handle body comprising:

a first protrusion extending transversely from the centerline to a distal end;

a second protrusion extending transversely, in an opposite direction than the first protrusion, from the centerline to a distal end;

a first lever disposed within and pivotally coupled to the first protrusion at a pivot point adjacent the distal end of the first protrusion, the first lever configured to independently actuate a latch mechanism, where the first lever is configured to pivot about the distal end of the first protrusion, and where the first lever has a first index wing extending towards the second end; and a second lever disposed within and pivotally coupled to the second protrusion at a pivot point that is adjacent the distal end of the second protrusion, the second lever configured to independently actuate the latch mechanism, where the second lever is configured to pivot about the distal end of the second protrusion, and where the second lever has a second index wing extending towards the second end.

* * * * *